US007922783B2

(12) United States Patent
Sakurai et al.

(10) Patent No.: US 7,922,783 B2
(45) Date of Patent: Apr. 12, 2011

(54) POLISHING PAD AND PRODUCTION METHOD THEREOF

(75) Inventors: Fujio Sakurai, Tokyo (JP); Iwao Mihara, Tokyo (JP); Yoshinori Igarashi, Tokyo (JP); Kou Hasegawa, Tokyo (JP)

(73) Assignee: JSR Corporation, Tokyo (JP)

( * ) Notice: Subject to any disclaimer, the term of this patent is extended or adjusted under 35 U.S.C. 154(b) by 190 days.

(21) Appl. No.: 12/197,643

(22) Filed: Aug. 25, 2008

(65) Prior Publication Data

US 2008/0313967 A1 Dec. 25, 2008

Related U.S. Application Data

(63) Continuation of application No. 10/822,815, filed on Apr. 13, 2004, now abandoned.

(30) Foreign Application Priority Data

Apr. 15, 2003 (JP) ..... 2003-110853

(51) Int. Cl.
*C09K 3/14* (2006.01)
*B24D 11/00* (2006.01)

(52) U.S. Cl. ..... 51/298; 51/293; 51/297; 451/41; 451/526; 451/534

(58) Field of Classification Search ..... 51/298, 51/293, 297; 451/41, 526, 534
See application file for complete search history.

(56) References Cited

U.S. PATENT DOCUMENTS

| | | | |
|---|---|---|---|
| 4,576,612 | A | 3/1986 | Shukla et al. |
| 5,976,000 | A | 11/1999 | Hudson |
| 6,477,926 | B1 | 11/2002 | Swisher et al. |
| 7,112,125 | B2 | 9/2006 | Hirabayashi et al. |
| 2003/0003857 | A1 | 1/2003 | Shimagaki et al. |
| 2003/0060138 | A1 | 3/2003 | Hasegawa et al. |
| 2004/0157985 | A1 | 8/2004 | Masui et al. |

FOREIGN PATENT DOCUMENTS

| | | |
|---|---|---|
| EP | 0 192 047 | 8/1986 |
| EP | 1 252 973 | 10/2002 |
| JP | 08-500622 | 1/1996 |
| JP | 2000-033552 | 2/2000 |
| JP | 2000-034416 | 2/2000 |
| JP | 2001-334455 | 12/2001 |
| WO | WO 94/04599 | 3/1994 |
| WO | WO 02/083757 | 10/2002 |

*Primary Examiner* — Elizabeth D Wood
(74) *Attorney, Agent, or Firm* — Oblon, Spivak, McClelland, Maier & Neustadt, L.L.P.

(57) ABSTRACT

There are provided a polishing pad which exhibits excellent polishing stability and excellent slurry retainability during polishing and even after dressing, can prevent a reduction in polishing rate effectively and is also excellent in an ability to flatten an substrate to be polished, and a method for producing the polishing pad. The method comprises dispersing water-soluble particles such as β-cyclodextrin into a crosslinking agent such as a polypropylene glycol so as to obtain a dispersion, mixing the dispersion with a polyisocyanate such as 4,4'-diphenylmethane diisocyanate and/or an isocyanate terminated urethane prepolymer, and reacting the mixed solution so as to obtain a polishing pad having the water-soluble particles dispersed in the matrix.

12 Claims, No Drawings

POLISHING PAD AND PRODUCTION METHOD THEREOF

This application is a Continuation of U.S. application Ser. No. 10/822,815, filed on Apr. 13, 2004, now abandoned.

BACKGROUND OF THE INVENTION

1. Field of the Invention

The present invention relates to a polishing pad and a method for producing the same. More specifically, it relates to a polishing pad which has a polishing layer comprising a polymer matrix and water-soluble particles dispersed in the polymer matrix, and a method for producing the same. The pad can be suitably used for polishing the surfaces of a semiconductor wafer and other objects to be polished.

2. Description of the Related Art

As a polishing method capable of forming a surface with a high degree of smoothness, CMP (Chemical Mechanical Polishing) has been receiving attention in recent years. In the CMP, a surface to be polished is polished by sliding a polishing pad and the surface against each other with slurry which is a water-based dispersion having abrasive particles dispersed therein caused to flow down on the surface of the polishing pad from above. One of factors which significantly affect productivity in this CMP is a polishing rate. It is conceived that this polishing rate can be significantly improved by increasing the amount of retained slurry from a conventional amount.

In the CMP, heretofore, a polyurethane foam containing fine air bubbles is used as the polishing pad, and polishing is performed with the slurry retained in holes (hereinafter referred to as "pores") opened on a surface of the resin foam.

However, it is difficult to control the degree of foaming in the polyurethane foam to a desired degree. It is very difficult to control the sizes of the air bubbles, a foaming density and other properties uniformly throughout the foam. Consequently, the quality of the polishing pad comprising the polyurethane foam varies, thereby causing a variation in the polishing rate and the state of the produced polishing pad.

Various resins having soluble materials dispersed therein are known as polishing pads whose formation of pores by foaming can be controlled more easily (JP-A 8-500622 and JP-A 2000-33552, JP-A 2000-34416 and JP-A 2001-334455). Of these publications, the former two publications suggest the effectiveness of the polishing pad containing a soluble material. However, studies with respect to a polymer matrix when actually used as the polishing pad have not been made. Meanwhile, in the latter two publications, constitutional materials thereof are studied, and more stable polishing and an improvement in polishing rate are recognized. However, much more stable polishing and further improvements in slurry retainability and the polishing rate are required.

In addition, a further improvement in the level of flattening a substrate to be polished is also required.

SUMMARY OF THE INVENTION

The present invention has been conceived in view of the above circumstances. An object of the present invention is to provide a polishing pad which exhibits excellent polishing stability and excellent slurry retainability during polishing and even after dressing, shows a high polishing rate, is excellent in an ability to flatten a substrate to be polished and is free from the occurrence of scratches, and a method for producing the polishing pad.

Other objects and advantages of the present invention will become apparent from the following description.

According to the present invention, firstly, the above objects and advantages of the present invention are achieved by a method for producing a polishing pad which comprises the steps of:

dispersing water-soluble particles in a crosslinking agent to produce a dispersion, mixing the dispersion with a polyisocyanate and/or an isocyanate terminated urethane prepolymer to produce a mixed solution, and reacting the mixed solution to produce a polishing pad comprising a polishing layer having the water-soluble particles dispersed in a polymer matrix.

According to the present invention, secondly, the above objects and advantages of the present invention are achieved by a polishing pad obtained by the above method of the present invention which comprises a polishing layer having water-soluble particles dispersed in a polymer matrix.

DETAILED DESCRIPTION OF THE PREFERRED EMBODIMENTS

Hereinafter, the present invention will be described in detail.

In a polishing pad, pores having functions such as retaining slurry at the time of polishing and retaining polishing wastes temporarily must be formed by the time of polishing. A polishing pad of the present invention has a polishing layer which comprises a polymer matrix comprising a polyurethane or a polyurethane-urea and water-soluble particles dispersed in the polymer matrix. The water-soluble particles make contact with slurry containing a medium and a solid at the time of polishing and are detached by dissolving into water or swelling due to water. Thereby, pores can be produced. Owing to this mechanism, pores which are suitable for retaining slurry and excellent in uniformity of pore sizes are formed in the surface layer of the polishing pad of the present invention which retains the slurry required for polishing. Further, since the inside of the pad in which the water-soluble particles exist is a non-porous structure, the polishing pad has a high degree of hardness and a high compressive strength and has an excellent ability to flatten a substrate to be polished. Further, since a polymer matrix which is excellent in rupture strength and abrasion resistance is obtained, deformation and abrasion of the surface of the pad can be suppressed against a high pressure that the polishing pad receives from a substrate to be polished during polishing or an external force such as a dressing treatment by a diamond dresser, excellent polishing stability and slurry retainability can be obtained, and a high polishing rate can be attained.

Water-Soluble Particles

In the present invention, the water-soluble particles are dispersed in the polymer matrix. When the polishing pad is in use, the water-soluble particles are detached from the water-insoluble polymer matrix when they make contact with water for a dressing treatment or slurry which is a water-based dispersion for polishing in the surface layer of the pad. The detachment may also occur when the water-soluble particles make contact with and dissolve into water or water contained in the slurry. The detachment may also occur when the water-soluble particles swell by absorbing the water and become gel. Further, in addition to water, the water-soluble particles may also be dissolved or swollen by making contact with a water-based mixed medium containing an alcohol-based solvent such as methanol.

In addition to the effect of forming pores, the water-soluble particles also have an effect of increasing the degree of indentation hardness of the polishing pad by being present inside the polishing pad so as to reduce the degree of indentation of a substrate to be polished by pressing. For example, the polishing pad of the present invention can have a Shore D hardness of 35 or higher, more preferably 50 to 95, much more preferably 60 to 90, by containing the water-soluble particles. When the Shore D hardness is 35 or higher, a high pressure can be applied to the substrate to be polished, and a polishing rate can be improved accordingly.

In addition, high polishing flatness of the substrate to be polished is achieved by the presence of the water-soluble particles. Thus, the water-soluble particles are preferably solid particles which can ensure satisfactory indentation hardness in the polishing pad.

A material constituting the water-soluble particles is not particularly limited. For example, organic water-soluble particles and inorganic water-soluble particles can be used. Illustrative examples of materials of the organic water-soluble particles include saccharides such as starch, polysaccharides such as dextrin and cyclodextrin, lactose, mannitol, celluloses such as hydroxypropylcellulose and methylcellulose, proteins, a polyvinyl alcohol, a polyvinyl pyrrolidone, a polyacrylic acid and salts thereof, a polyethylene oxide, water-soluble photosensitive resins, a sulfonated polyisoprene and a sulfonated polyisoprene copolymer. Meanwhile, illustrative examples of materials of the inorganic water-soluble particles include potassium acetate, potassium nitrate, potassium carbonate, potassium bicarbonate, potassium chloride, potassium bromide, potassium phosphate and magnesium nitrate. The above materials of the water-soluble particles may be used alone or in combination of two or more.

Further, the average particle diameter of the water-soluble particles is preferably 0.1 to 500 μm, more preferably 0.5 to 300 μm, much more preferably 1 to 100 μm, most preferably 10 to 90 μm. Further, the sizes of the pores which have been formed by detachment of water-soluble particles are preferably 0.1 to 500 μm, more preferably 0.5 to 300 μm, much more preferably 1 to 100 μm, particularly preferably 10 to 90 μm. When the average particle diameter of the water-soluble particles is smaller than 0.1 μm, pores which are smaller in size than abrasive particles used are formed, so that it is liable to become difficult to obtain a polishing pad which can retain slurry sufficiently. Meanwhile, when the average particle diameter is larger than 500 μm, pores of excessive sizes are formed, so that a polishing pad with low mechanical strength and a low polishing rate is liable to be obtained.

The content of the water-soluble particles is preferably 0.5 to 70% by volume, more preferably 1 to 60% by volume, much more preferably 2 to 45% by volume, when the polishing layer comprising the water-soluble particles and the polymer matrix is 100% by volume. When the content of the water-soluble particles is lower than 0.5% by volume, sufficient pores are not formed in the polishing pad to be obtained, so that the polishing rate of the pad is liable to be low. Meanwhile, when the content of the water-soluble particles is higher than 70% by volume, it is liable to be difficult to fully prevent swelling or dissolution of the water-soluble particles present in the polishing pad at the time of polishing, and it is therefore difficult to keep the hardness and mechanical strength of the polishing pad at proper values.

Further, the content of the water-soluble particles on a weight basis can be calculated in the following manner. For example, when a saccharide having a specific gravity of about 1.5 is used as the water-soluble particles and a polyurethane showing a specific gravity of 1.15 after completion of the reaction is used as the polymer matrix, the water-soluble particles are 0.7 to 75.3 wt %, more preferably 1.3 to 66.2 wt %, much more preferably 2.6 to 51.6 wt % based on the polishing layer which is 100 wt %. Further, when a polyacrylic acid, polyvinyl pyrrolidone or polyethylene oxide having a specific gravity of about 1.15 is used as the water-soluble particles and a polyurethane showing a specific gravity of 1.15 after completion of the reaction is used as the polymer matrix, the water-soluble particles are 0.5 to 70 wt %, more preferably 1 to 60 wt %, much more preferably 2 to 45 wt % based on the polishing layer which is 100 wt %. In addition, when inorganic water-soluble particles such as potassium nitrate having a specific gravity of about 2 are used as the water-soluble particles and a polyurethane showing a specific gravity of 1.15 after completion of the reaction is used as the polymer matrix, the water-soluble particles are 0.9 to 80.2 wt %, more preferably 1.7 to 72.3 wt %, much more preferably 3.4 to 58.7 wt % based on the polishing layer which is 100 wt %.

Further, it is preferable that the water-soluble particles be dissolved into water only when exposed to the surface layer of the polishing pad and neither absorb moisture nor swell inside the polishing pad. Thus, the water-soluble particle may have an outer shell for inhibiting moisture absorption on at least a portion of its surface. This outer shell may be physically adsorbed or chemically bonded to the water-soluble particle. The shell may also be in contact with the water-soluble particle by both physical adsorption and chemical bonding. Illustrative examples of materials which form such an outer shell include an epoxy resin, a polyimide resin, a polyamide resin and a silicon resin. The outer shell can still exert the above effect sufficiently even when it is formed on only a portion of the surface of the water-soluble particle.

Crosslinking Agent

In the present invention, the crosslinking agent is a compound which has, in a molecule, at least two functional groups having active hydrogen reactable with an isocyanate group of a polyisocyanate to be described later. Illustrative examples of the functional groups having active hydrogen include a hydroxyl group, a primary amino group, a secondary amino group and a carboxyl group. In view of high reactivity with an isocyanate group, the hydroxyl group and the amino groups are preferred. Further, the hydroxyl group is more preferable for achieving good dispersion of the water-soluble particles. The number of the active-hydrogen-containing functional groups in a molecule is at least 2 and may be 2 to 4 in particular. Of these, 2 or 3 is preferred. Further, compounds having one or more of these functional groups, e.g., a compound having two active-hydrogen-containing functional groups in a molecule and a compound having three active-hydrogen-containing functional groups in a molecule, may be used in combination. An example of a hydroxyl-group-containing compound is a polyol compound. Illustrative examples of the polyol compound include diol compounds having a hydroxyl group at both ends of a molecule such as a polyether diol, polyester diol, polycarbonate diol, polyether carbonate diol and polyester carbonate diol. In addition, a polyfunctional polyether polyol, a polyfunctional polyester polyol, a polyfunctional polycarbonate polyol, a polyfunctional polyether carbonate polyol or a polyfunctional polyester carbonate polyol which has at least three hydroxyl groups in a molecule can also be used. Further, a polyfunctional low-molecular-weight alcohol having at least two hydroxyl groups in a molecule can also be used.

Illustrative examples of the diol compounds having two hydroxyl groups at both ends of a molecule include a polyether diol such as an aliphatic polyether diol, an alicyclic polyether diol or an aromatic polyether diol, a polyester diol, a polycarbonate diol, a polycaprolactone diol, a polyol synthesized by a reaction between a diol and a polyisocyanate, and other polyols. These polyols may be used alone or in combination of two or more.

Specific examples of the aliphatic polyether diol include a polyethylene glycol, a polypropylene glycol, a polytetramethylene glycol, a polyhexamethylene glycol, a polyheptamethylene glycol, a polydecamethylene glycol, and a polyether diol obtained by subjecting at least two ion polymerizable cyclic compounds to ring-opening copolymerization.

Specific examples of the above cyclic compounds include cyclic ethers such as ethylene oxide, propylene oxide, butene-1-oxide, isobutene oxide, 3,3-bischloromethyloxetane, tetrahydrofuran, 2-methyl tetrahydrofuran, 3-methyl tetrahydrofuran, dioxane, trioxane, tetraoxane, cyclohexene oxide, styrene oxide, epichlorohydrin, glycidyl methacrylate, allyl glycidyl ether, allyl glycidyl carbonate, butadiene monoxide, isoprene monoxide, vinyl oxetane, vinyl tetrahydrofuran, vinyl cyclohexene oxide, phenyl glycidyl ether, butyl glycidyl ether and glycidyl benzoate.

Specific examples of the polyether diol obtained by subjecting at least two ion polymerizable cyclic compounds to ring-opening copolymerization include binary copolymer diols obtained from a combination of tetrahydrofuran and propylene oxide, a combination of tetrahydrofuran and 2-methyl tetrahydrofuran, a combination of tetrahydrofuran and 3-methyl tetrahydrofuran, a combination of tetrahydrofuran and ethylene oxide, a combination of propylene oxide and ethylene oxide and a combination of butene-1-oxide and ethylene oxide; and a ternary polymer diol obtained from a combination of tetrahydrofuran, butene-1-oxide and ethylene oxide.

Further, a polyether diol obtained by subjecting the above cyclic compound and a cyclic imine such as ethylene imine; a cyclic lactonic acid such as β-propiolactone or lactide glycolate; or dimethylcyclopolysiloxane to ring-opening copolymerization can also be used. The above aliphatic polyether diols are also available as commercial products such as PTMG650, PTMG1000 and PTMG2000 (products of Mitsubishi Chemical Corporation), PPG400, PPG1000 and EXENOL720, 1020 and 2020 (products of ASAHI-OLIN LTD.), PEG1000 and UNISAFE DC1100 and DC1800 (products of NOF CORPORATION), PPTG2000, PPTG1000, PTG400 and PTGL2000 (products of HODOGAYA CHEMICAL CO., LTD.), Z-3001-4, Z-3001-5, PBG2000A, PBG2000B, EO/BO4000 and EO/BO2000 (products of DAI-ICHI KOGYO SEIYAKU CO., LTD.), PolyTHF250, PolyTHF650, PolyTHF1000, PolyTHF1800, PolyTHF2000 (products of BASF Japan Ltd.).

Specific examples of the alicyclic polyether diol include an alkylene oxide added diol of hydrogenated bisphenol A, an alkylene oxide added diol of hydrogenated bisphenol F, and an alkylene oxide added diol of 1,4-cyclohexanediol. Further, specific examples of the aromatic polyether diol include an alkylene oxide added diol of bisphenol A, an alkylene oxide added diol of bisphenol F, an alkylene oxide added diol of hydroquinone, an alkylene oxide added diol of naphthohydroquinone, and an alkylene oxide added diol of anthrahydroquinone. The above aromatic polyether diols are also available as commercial products such as UNIOL DA400, DA700, DA1000 and DA4000 (products of NOF CORPORATION).

Illustrative examples of the polyester diol include a polyester diol obtained by reacting a polyhydric alcohol with a polybasic acid. Specific examples of the polyhydric alcohol include ethylene glycol, a polyethylene glycol, propylene glycol, a polypropylene glycol, tetramethylene glycol, a polytetramethylene glycol, 1,6-hexanediol, neopentyl glycol, 1,4-cyclohexane dimethanol, 3-methyl-1,5-pentanediol, 1,9-nonanediol, and 2-methyl-1,8-octanediol. Specific examples of the polybasic acid include phthalic acid, isophthalic acid, terephthalic acid, maleic acid, fumaric acid, adipic acid, and sebacic acid.

Specific examples of commercial products of the above polyester diol include KURAPOL P-2010, P-1010, L-2010, L-1010, A-2010, A-1010, F-2020, F-1010, PMIPA-2000, PKA-A, PNOA-2010 and PNOA-1010 (products of KURARAY CO., LTD.).

Specific examples of the polycarbonate diol include a polycarbonate of a polytetrahydrofuran and a polycarbonate of 1,6-hexanediol. Specific examples of commercial products of the polycarbonate diol include DN-980, 981, 982 and 983 (products of NIPPON POLYURETHANE INDUSTRY CO., LTD.), PC-8000 (product of PPG Industries, Inc.) and PC-THF-CD (product of BASF Aktiengesellshaft).

Illustrative examples of the polycaprolactone diol include a polycaprolactone diol obtained by reacting ϵ-caprolactone with a diol. Specific examples of the diol reacting with ϵ-caprolactone include ethylene glycol, a polyethylene glycol, propylene glycol, a polypropylene glycol, tetramethylene glycol, a polytetramethylene glycol, a 1,2-polybutylene glycol, 1,6-hexanediol, neopentyl glycol, 1,4-cyclohexane dimethanol and 1,4-butanediol. These polycaprolactone diols are available as commercial products such as PLACCEL 205, 205AL, 212, 212AL, 220 and 220AL (products of DAICEL CHEMICAL INDUSTRIES, LTD.).

Illustrative examples of the polyol compound having at least three hydroxyl groups in a molecule include a polyether polyol, polyester polyol, polycarbonate polyol, polyether carbonate polyol and polyester carbonate polyol which are obtained by using, as a starting polyol component, a triol such as glycerine, trimethylolpropane, 1,2,6-hexanetriol or triethanolamine or a tetraol such as pentaerythritol or tetramethylol cyclohexane; and a trifunctional addition reaction product represented by the following formula:

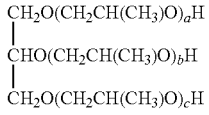

wherein a, b and c are each independently an integer of 0 to 100, in proviso that a, b and c is not 0 at the same time, and resulting from addition of propylene oxide to glycerine. The trifunctional addition reaction product is available as a commercial product such as UNIOL TG330 (product of NOF CORPORATION).

Specific examples of the low-molecular-weight alcohol having at least two hydroxyl groups in a molecule include ethylene glycol, 1,3-propanediol, 1,4-butanediol, 1,6-hexanediol, and trimethylolpropane.

An example of a compound having a primary or secondary amino group is a polyamine compound. Specific examples of the polyamine compound include organic diamine compounds such as 3,3'-dichloro-4,4'-diaminodiphenylmethane, chloroaniline modified dichlorodiaminodiphenylmethane, 1,2-bis(2-aminophenylthio)ethane, trimethylene glycol-di-p-amino benzoate and 3,5-bis(methylthio)-2,6-toluene diamine. Further, a compound having three or more primary or secondary amino groups in a molecule can also be used.

Illustrative examples of a carboxyl-group-containing compound include aliphatic, aromatic, alicyclic and heterocyclic dicarboxylic acid, tricarboxylic acid and tetracarboxylic acid.

Specific examples of the aliphatic dicarboxylic acid include oxalic acid, malonic acid, succinic acid, glutaric acid, adipic acid, azelaic acid and sebacic acid.

Specific examples of the aromatic dicarboxylic acid include phthalic acid, isophthalic acid and terephthalic acid. Specific examples of the alicyclic dicarboxylic acid include cyclohexyldicarboxylic acid. Specific examples of the heterocyclic dicarboxylic acid include naphthalenedicarboxylic acid. Specific examples of the aliphatic tricarboxylic acid include citric acid and aconitic acid.

As the crosslinking agent in the present invention, the above active-hydrogen-containing compounds can be used alone or in combination of two or more. Of these, a compound containing two and/or three active hydrogens in a molecule is preferably used.

Particularly, as the compound containing two or three active hydrogens in a molecule, the above diol and triol are preferably used. When the diol and the triol are used in combination, the amount of the diol is preferably 5 to 90 wt %, more preferably 20 to 70 wt %, based on the total of the diol and the triol which is 100 wt %. With the amounts of the diol and triol within this range, well-balanced elongation and rupture strength can be imparted to the polymer matrix such as urethane which forms the pad.

The crosslinking agent preferably contains a component having a number average molecular weight of not higher than 5,000 in an amount of not smaller than 30 wt %, more preferably contains a component having a number average molecular weight of not higher than 2,000 in an amount of not smaller than 50 wt % and much more preferably contains a component having a number average molecular weight of not higher than 1,000 in an amount of not smaller than 70 wt %, based on the total of the crosslinking agent which is 100 wt %.

The crosslinking agent particularly preferably contains a component having a number average molecular weight of not higher than 1,000 in an amount of 100 wt %.

As the low-molecular-weight component in the crosslinking agent increases, polar bonds produced by bonding to isocyanate increase in the eventually obtained polyurethane and intermolecular hydrogen bonds increase. As a result, a cohesive force between molecules becomes high, and a strong polymer matrix which can bear deformation or rupture caused by an external force to a sufficient degree can be obtained.

Dispersion

The dispersion in the present invention is obtained by dispersing the above water-soluble particles in the above crosslinking agent. A method of dispersing the water-soluble particles is not particularly limited. For example, it is preferred that the water-soluble particles be gradually added and dispersed while the crosslinking agent is stirred in a container, so as to obtain a good dispersion. Particularly preferred is a method of dispersing the particles by a twin-screw stirring mixer which provides a shearing force. A defoaming treatment by depressurization or other means may be carried out during or after dispersing as required.

Further, a dispersion aid can also be used as required. Illustrative examples of the dispersion aid include a polymer, block copolymer or random copolymer modified by an acid anhydride group, acarboxyl group, a hydroxyl group, an epoxy group, an oxazoline group or an amino group, and various nonionic surfactants and coupling agents.

Polyisocyanate

As the polyisocyanate in the present invention, a compound having at least two isocyanate groups in a molecule is used. As the polyisocyanate compound, aromatic di- or triisocyanate, aliphatic di- or triisocyanate, alicyclic di- or triisocyanate and a modified polyisocyanate are preferably used. Specific examples of the aromatic di- or triisocyanate include 2,4-tolylene diisocyanate, 2,6-tolylene diisocyanate, phenylene diisocyanate, xylylene diisocyanate, tetramethylxylene diisocyanate, 2,2'-diphenylmethane diisocyanate, 2,4'-diphenylmethane diisocyanate, 4,4'-diphenylmethane diisocyanate, tolidine diisocyanate[bis(4-isocyanate-3-methylphenyl)methane], triphenylmethane triisocyanate and 1,5-naphthalene diisocyanate. Specific examples of the aliphatic di- or triisocyanate include 1,4-tetramethylene diisocyanate, 1,6-hexamethylene diisocyanate, trimethylhexamethylene diisocyanate, 1,10-decamethylene diisocyanate, lysine diisocyanate and 1,3,6-hexamethylene triisocyanate. Specific examples of the alicyclic di- or triisocyanate include isophorone diisocyanate, hydrogenated xylylene diisocyanate and hydrogenated diphenylmethane diisocyanate. Specific examples of the modified polyisocyanate include an adduct resulting from addition of a polyisocyanate to a polyhydric alcohol, a dimer, a trimer with an isocyanurate ring, modified allophanate, an urea modified polyisocyanate and a buret modified polyisocyanate. Of these, the aromatic di- or triisocyanate and the aliphatic di- or triisocyanate are preferably used, and the aliphatic diisocyanate and the aromatic diisocyanate are particularly preferably used. The above isocyanates can be used alone or in combination of two or more.

Isocyanate Terminated Urethane Prepolymer

The isocyanate terminated urethane prepolymer is obtained by reacting a compound having at least two hydroxyl groups in a molecule with a polyisocyanate in an equivalent ratio of the hydroxyl group/an isocyanate group of preferably 1/1.8 to 1/2.4, more preferably 1/1.9 to 1/2.2. When the equivalent ratio of the isocyanate group is less than 1.8, unreacted hydroxyl groups, i.e., a compound having an isocyanate group at only one end becomes excessive, thereby causing the polyurethane matrix to be obtained to have a low molecular weight or causing the unreacted OH groups to remain in the polymer matrix; as a result, a change with time in polishing performance due to deteriorations in the rupture strength, abrasion resistance and water resistance of the polyurethane matrix occurs. Meanwhile, when the equivalent ratio of the isocyanate group is more than 2.4, the isocyanate terminated urethane prepolymer to be obtained is liable to have poor storage stability disadvantageously.

In synthesis of the isocyanate terminated urethane prepolymer, the temperature may be increased to a temperature of 50 to 90° C., and a tertiary amine or a metal catalyst such as organotin may be used as a reaction catalyst. As the compound having at least two hydroxyl groups in a molecule, the same compounds as the hydroxyl-group-containing compounds enumerated with respect to the above crosslinking agent can be used, for example. As the polyisocyanate, the same compounds as those enumerated with respect to the foregoing polyisocyanate can be used, for example.

One or more of the above isocyanate terminated urethane prepolymers may be used.

Mixed Solution of Dispersion with Polyisocyanate and/or Isocyanate Terminated Urethane Prepolymer, and Reaction thereof As a method of preparing and reacting the above mixed solution, any of (1) a one-shot method using only the polyisocyanate as an isocyanate raw material without using an isocyanate terminated prepolymer, (2) a prepolymer method using only the isocyanate terminated prepolymer as an isocyanate raw material and (3) a combination method using a combination of the polyisocyanate and the isocyanate terminated prepolymer as an isocyanate raw material can be employed. In any case, the water-soluble particles are dispersed in the crosslinking agent in advance, the resulting dispersion is mixed with the isocyanate raw material, and a curing reaction is carried out so as to form the polymer matrix. Thereby, inhibition of the polymer matrix curing reaction by the water-soluble particles can be prevented, and the water-soluble particles can be dispersed uniformly in the polymer matrix to be obtained.

Further, of the above reaction methods, the prepolymer method and the combination method are particularly preferred so as to precisely control the molecular structure of the polymer matrix to be obtained.

In the present invention, the crosslinking agent having an active-hydrogen-containing functional group, the polyisocyanate and the isocyanate terminated prepolymer are used in a ratio of active-hydrogen-containing groups/isocyanate groups of preferably 1/0.9 to 1/1.4, more preferably 1/0.95 to 1/1.3. When the ratio of the isocyanate to the active-hydrogen-containing groups is less than 0.9, a large amount of the active-hydrogen-containing groups remain unreacted, so that the polyurethane to be obtained has poor water resistance, alkali resistance and acid resistance. When the ratio of the isocyanate is more than 1.4, a large amount of the isocyanate groups remain unreacted upon completion of the polymerization reaction. The unreacted isocyanate groups cause a crosslinking reaction as time elapses due to moisture, so that the polymer matrix to be obtained becomes brittle.

In the synthesis reaction of the polymer matrix in the present invention, the raw material mixture may be given heat energy by heating, or a reaction accelerator may also be used as required, so as to accelerate the reaction. Illustrative examples of the reaction accelerator include tertiary amines such as triethylamine, benzyldimethylamine, triethylene diamine, tetramethylbutane diamine and 2-methyl-triethylene diamine, tin compounds such as dibutyltin acetate, dibutyltin dilaurate, dibutyltin maleate, dibutyltin di-2-ethylhexoate, dilauryltin diacetate and dioctyltin diacetate, and a diazabicycloalkene and salts thereof with organic acids.

For a polishing pad for a semiconductor wafer, the tertiary amines and the diazabicycloalkene and salts thereof are preferably used so as to prevent metal from remaining in the polishing layer.

The temperature, time and pressure in the synthesis reaction of the polymer matrix are not particularly limited. For a first curing reaction, conditions under which the polymer matrix can be reacted to a certain extent and released from a mold with low adhesion and deformation are preferred. For example, the reaction is preferably carried out at 30 to 170° C. for 3 minutes to 24 hours, more preferably at 50 to 130° C. for 5 minutes to 3 hours. Although it is possible to complete the curing reaction by the first reaction, it is preferable to hold the polymer matrix at 80 to 150° C. for 3 to 24 hours after completion of the first reaction and carry out a second curing reaction, for the purpose of fully completing the curing reaction.

Other Usable Additives

In addition to the foregoing components, the polymer matrix and/or the water-soluble particles may contain one or more of additives which are conventionally used in slurry, e.g., polishing particles, an oxidizing agent and a surfactant. Thereby, polishing can be carried out by giving only water to the polishing pad at the time of polishing.

Illustrative examples of the above polishing particles include silica particles, alumina particles, ceria particles, zirconia particles, and titania particles. These can be used alone or in combination of two or more.

Illustrative examples of the oxidizing agent include hydrogen peroxide, peracetic acid, perbenzoic acid, organic peroxides such as t-butyl hydroperoxide, permanganic acid compounds such as potassium permanganate, dichromic acid compounds such as potassium dichromate, halogen acid compounds such as potassium iodate, nitric acid compounds such as iron nitrate, perhalogen acid compounds such as perchloric acid, persulfates such as ammonium persulfate and a heteropoly acid. Of these oxidizing agents, hydrogen peroxide, the organic peroxides and the persulfates such as ammonium persulfate are particularly preferred because their decomposition products are harmless. These can be used alone or in combination of two or more.

Illustrative examples of the above surfactant include a cationic surfactant, an anionic surfactant and a nonionic surfactant. Specific examples of the cationic surfactant include an aliphatic amine salt and an aliphatic ammonium salt. Specific examples of the anionic surfactant include fatty acid soap, carboxylates such as an alkyl ether carboxylate, sulfonates such as an alkyl benzene sulfonate, an alkyl naphthalene sulfonate and α-olefin sulfonate, sulfates such as a higher alcohol sulfate, an alkyl ether sulfate and a polyoxyethylene alkyl phenyl ether sulfate, and phosphates such as an alkyl phosphate. These can be used alone or in combination of two or more.

Further, in the polymer matrix, various other additives such as a filler, a softener, an antioxidant, an ultraviolet absorber, an antistatic agent, a lubricant and a plasticizer may be contained as required, in addition to the above various materials which are conventionally used in slurry. Of these, as the filler, a material which improves rigidity such as calcium carbonate, magnesium carbonate, talc or clay or a material having a polishing effect such as silica, alumina, ceria, titania, zirconia, manganese dioxide, dimanganese trioxide and barium carbonate may be used.

To incorporate the above usable additives into the polishing layer of the polishing pad of the present invention, they must be added to the raw materials used for forming the polymer matrix in advance.

Polishing Pad

The polishing pad of the present invention is obtained as a polishing pad which has a polishing layer having the water-soluble particles dispersed in the polymer matrix by subjecting the above mixed solution comprising the dispersion and the polyisocyanate and/or the isocyanate terminated urethane prepolymer to the reaction, for example, in a mold.

Further, the polishing pad preferably shows a tensile product of 50 to 20,000 kgf/cm when a dumbbell-shaped type 3 test piece is subjected to a tensile test which is conducted at a pulling rate of 500 mm/min and a testing temperature of 30° C. in accordance with the JIS K 6251 "Method of Conducting Tensile Test for Vulcanized Rubber" and ruptured. The tensile product is more preferably 100 to 18,000 kgf/cm, much more preferably 500 to 15,000 kgf/cm.

When the tensile product is smaller than 50 kgf/cm, the polishing layer is liable to be broken and has poor abrasion resistance, and the useful life of the polishing pad is short. Meanwhile, when it is larger than 20,000 kgf/cm, the polishing layer is hardly broken, so that surface roughening by a diamond dresser during use of the polishing pad does not easily occur, retention of slurry on the surface of the polishing pad is insufficient, and the polishing rate is low.

It is sufficient for the polishing layer to constitute at least a portion of the polishing surface of the polishing pad. The polishing layer preferably constitutes at least 50% of the polishing surface, more preferably at least 80% of the polishing surface, much more preferably at least 90% of the polishing surface. As a matter of course, the whole polishing surface may comprise the polishing layer.

An example of a portion other than the polishing layer is a window portion for detecting an end point by use of an optical end-point detecting device. As the window portion, a window portion which shows a light transmittance of 0.1% or higher, preferably 2% or higher, for light of any wavelength between 100 nm and 3,000 nm at a thickness of 2 mm or shows an integration transmittance in any wavelength range between 100 nm and 3,000 nm of 0.1% or higher, preferably 2% or higher can be used.

Further, the polishing pad may be a single-layer pad or a multilayer pad having other layers. When the polishing pad is the multilayer pad, the polishing layer is included in the multilayer pad as a portion constituting a polishing surface in the multilayer pad. Illustrative examples of the layers other than the polishing layer include a supporting layer disposed on the surface opposite to the polishing surface of the polishing layer and a bonding layer for laminating the supporting layer and the polishing layer.

The above supporting layer is a layer which supports the polishing layer from the rear surface side thereof. The characteristics of the supporting layer are not particularly limited, but it is preferably softer than the polishing layer. With a softer supporting layer, it can be prevented that the polishing layer rises or the surface of the polishing layer bends at the time of polishing and stable polishing can be performed, even when the thickness of the polishing layer is as small as 0.5 mm or smaller. The hardness of the supporting layer is generally not lower than 10%, preferably not higher than 90%, more preferably not higher than 80%, particularly preferably not higher than 70% of the hardness of the polishing layer. Further, the Shore D hardness of the supporting layer is generally 1 or higher, preferably 70 or lower, more preferably 60 or lower, much more preferably 50 or lower.

Further, the supporting layer may be a foam or non-foam. In addition, the shape of its plane surface is not particularly limited and may be the same as or different from that of the polishing layer. The shape of the plane surface of the supporting layer may be a circular shape or a polygonal shape such as a rectangular shape, for example. Further, the thickness of the supporting layer is also not particularly limited and may be preferably 0.1 to 5 mm, more preferably 0.5 to 2 mm, for example. When the polishing layer has the window portion for detecting an end point by use of an optical end-point detecting device, the supporting layer may also have a window portion which is similar to or the same as that of the polishing layer so as not to block light passing through the above window portion or may have a clipped shape so as to allow light to pass through a clipped portion without having window portion.

A material constituting the supporting layer is also not particularly limited. An organic material is preferably used because it is easily molded into a given shape and a given characteristic and can impart moderate elasticity. As the organic material, a variety of polymers can be used. The organic material constituting the supporting layer may be a crosslinked polymer, a pre-crosslinked polymer or an uncrosslinked polymer.

Further, the supporting layer may comprise only one layer or two or more layers. In addition, the supporting layer and the polishing layer may be in direct contact with each other and laminated by such a method as thermal fusion. They may be laminated via the above bonding layer. The bonding layer may be a layer of a cured adhesive or a layer comprising an adhesive material such as an adhesive tape.

The shape of the polishing pad of the present invention is not particularly limited and may be a disk, belt or roller, for example. The shape of the polishing pad is preferably selected as appropriate according to a polishing device. Further, the size of the polishing pad before use is also not particularly limited. In the case of a disk-shaped polishing pad, the diameter is preferably 0.5 to 500 cm, more preferably 1.0 to 250 cm, particularly preferably 20 to 200 cm, and the thickness is preferably larger than 0.1 mm and not larger than 100 mm, particularly preferably 1 to 10 mm.

This polishing pad may be used in any polishing step. For example, it may be used in an STI step in polishing a semiconductor wafer, a damascene step of forming metal wiring of Al and Cu, a damascene step in forming a via plug using Al, Cu and W, a dual damascene step of forming the metal wiring and the via plug simultaneously, a step of polishing an interlayer insulation film (such as an oxidized film, Low-k or BPSG), a step of polishing a nitrided film (such as TaN or TiN) and a step of polishing a polysilicon or bare silicon.

On the polishing surface of the polishing pad, an open groove can be formed. This groove has a function of retaining slurry supplied at the time of polishing and distributing the slurry on the polishing surface more uniformly. Further, the groove also serves as a discharge path for retaining wastes including abrasion chips produced by polishing and used slurry temporarily and discharging the wastes to the outside. The outer shape of the groove is not particularly limited and may be ring-shaped, lattice-shaped and/or spiral, for example.

The shape on a plane surface of a ring-shaped groove is not particularly limited and may be a circle, a polygon such as a triangle, a rectangle or a pentagon, or an oval. Further, the number of grooves formed on the polishing pad is not particularly limited as long as it is 2 or more. Further, the positions of these grooves are also not particularly limited. For example, these grooves may be disposed around the same center or concentrically, disposed eccentrically or disposed such that a plurality of other ring-shaped grooves are disposed inside the polishing surface surrounded by a cyclic groove. Of these configurations, a polishing pad having the grooves disposed around the same center is preferred, and a polishing pad having a plurality of ring-shaped grooves disposed concentrically is more preferred. The polishing pad having the grooves disposed around the same center is superior to other polishing pads with respect to the above functions. Further, by having the grooves concentrically, the polishing pad is further superior in these functions, and formation of the grooves is also easier.

Meanwhile, the shape of a cross section in the width direction of the groove is also not particularly limited and may be a shape formed by flat side faces and the flat bottom face (the width of the groove on its open side may be equal to, larger than or smaller than that on its bottom side), U-shaped or V-shaped, for example.

A lattice-shaped groove may be formed by one continuous groove or a plurality of independent grooves. Further, the shape on a plane surface of each pattern constituting the lattice is not particularly limited and may be a variety of polygons. Illustrative examples of the polygons include quadrangles such as a square, a rectangle, a trapezoid and a rhombus, a triangle, a pentagon and a hexagon.

Meanwhile, the shape of a cross section in the width direction of the groove is also not particularly limited and may be a shape formed by flat side faces and the flat bottom face (the width of the groove on its open side may be equal to, larger than or smaller than that on its bottom side), U-shaped or V-shaped, for example.

A spiral groove may be formed by one continuous groove or two spiral grooves whose spiral directions are different. Further, it may be formed by two spiral grooves whose spiral directions are the same or three or more spiral grooves whose spiral directions are the same or different.

Meanwhile, the shape of a cross section in the width direction of the groove is also not particularly limited and may be a shape formed by flat side faces and the flat bottom face (the width of the groove on its open side may be equal to, larger than or smaller than that on its bottom side), U-shaped or V-shaped, for example.

The size of the groove is not particularly limited. For example, the width of the groove is not smaller than 0.1 mm, more preferably 0.1 to 5 mm, much more preferably 0.2 to 3 mm. It is generally difficult to form a groove having a width or minimum size of smaller than 0.1 mm. Further, the depth of the groove is preferably not smaller than 0.1 mm, more preferably 0.1 to 2.5 mm, much more preferably 0.2 to 2.0 mm. When the depth of the groove is smaller than 0.1 mm, the useful life of the polishing pad is excessively short disadvantageously. Further, the distance between the grooves (for spiral grooves, a minimum distance between adjacent portions in the diameter direction) is preferably not smaller than 0.05 mm, more preferably 0.05 to 100 mm, much more preferably 0.1 to 10 mm. It is difficult to form a groove having a minimum distance of smaller than 0.05 mm. Further, a pitch which is the total of the width of a groove and the distance between the groove and an adjacent groove is preferably not smaller than 0.15 mm, more preferably 0.15 to 105 mm, much more preferably 0.3 to 13 mm, particularly preferably 0.5 to 2.2 mm.

The above preferable ranges may be combined. For example, it is preferred that the width be not smaller than 0.1 mm, the depth be not smaller than 0.1 mm and the minimum distance be not smaller than 0.05 mm; it is more preferred that the width be 0.1 to 5 mm, the depth be 0.1 to 2.5 mm and the minimum distance be 0.05 to 100 mm; and it is much more preferred that the width be 0.2 to 3 mm, the depth be 0.2 to 2.0 mm and the minimum distance be 0.1 to 10 mm.

Further, the surface roughness of the internal surface of the groove is preferably not larger than 20 μm, more preferably not larger than 15 μm, much more preferably not larger than 10 μm and generally not smaller than 0.05 μm. With a surface roughness of not larger than 20 μm, scratches at the time of polishing can be prevented effectively. It is to be understood that the surface roughness is a value before use of the polishing pad of the present invention.

When the internal surface of the groove has a surface roughness of not larger than 20 μm, the internal surface has no large pits and projections. When the internal surface has large pits and projections, particularly large projections, e.g., incompletely abraded portions produced in formation of the groove, are detached from the surface during polishing and cause the occurrence of scratches. Further, the scratches may also be produced by foreign matter formed by compression of the detached projections by a pressure or frictional heat during polishing or foreign matter formed by contact between the detached projections and abrasion chips or solids in slurry. Further, even during dressing, these projections may be detached and cause a similar problem.

Further, when the surface roughness is not larger than 20 μm, the occurrence of the scratches can be prevented, and the groove can exert functions as a groove, particularly a function of distributing slurry on the polishing surface and a function of discharging wastes to the outside, more efficiently.

In addition, the polishing pad of the present invention can also have pits opened on the polishing surface side, in addition to the grooves. The shape on a plane surface of the pit is not particularly limited and may be a circle, a polygon such as a triangle, a rectangle or a pentagon, or an oval, for example. Further, the shape of a cross section of the pit is also not particularly limited and may be a shape formed by flat side faces and the flat bottom face (the size in a transverse cross-sectional direction of the pit on its open side may be equal to, larger than or smaller than that on its bottom side), U-shaped or V-shaped, for example.

Further, as in the case of the surface roughness of the internal surface of the groove, the surface roughness of the internal surface of the pit is, for example, not larger than 20 μm, preferably not larger than 15 μm, more preferably not larger than 10 μm and generally not smaller than 0.05 μm.

Such a groove can be formed by cutting the surface of the polishing pad by a groove cutting machine with a blade. A material constituting the blade is not particularly limited. As the material, carbon steel, alloy steel, high-speed steel, a sintered hard alloy, cermet, stellite, a very high pressure sintered body and other ceramics can be used. The blade may be a single blade or a multi-blade unit having a plurality of blades.

Further, it is also possible that a female shape of the shape of such a groove is formed in a container (such as a mold) used for polymerization in advance and a raw material mixture is then poured into the container and undergoes a curing reaction so as to form a polishing layer having the shape of the groove formed on the surface without cutting.

EXAMPLES

Hereinafter, the present invention will be further described with respect to Examples and Comparative Example. The constitutions and evaluations of the polishing pads of Examples and Comparative Example are shown in Table 1. The units for numbers representing the amounts of constituents in Table 1 are parts by weight.

TABLE 1

| | Ex. 1 | Ex. 2 | Ex. 3 | Ex. 4 | Ex. 5 | C. Ex. 1 |
|---|---|---|---|---|---|---|
| <Water-Soluble Particles A> | | | | | | |
| β-cyclodextrin (Average Particle Diameter: 20 μm) | 14.5 | 14.5 | 70.0 | 4.0 | 2.5 | — |
| <Crosslinking Agent B> | | | | | | |
| B1 Trifunctional Addition Reaction Product of Glycerin and Propylene Oxide (Average Molecular Weight: 330 "UNIOL TG330") | 21.6 | 13.2 | 21.6 | 21.6 | — | 21.6 |
| B1 Trimethylolpropane ("TMP") | — | — | — | — | 2.2 | — |
| B2 Difunctional Polytetramethylene Glycol (Average Molecular Weight: 650 "PTMG650") | 6.9 | 17.4 | 6.9 | 6.9 | — | 6.9 |
| B2 1,6-hexanediol | — | — | — | — | 11.1 | — |
| (Proportion % of B2 when B1 + B2 = 100) | 24.2 | 56.9 | 24.2 | 24.2 | 83.5 | 24.2 |

TABLE 1-continued

| | Ex. 1 | Ex. 2 | Ex. 3 | Ex. 4 | Ex. 5 | C. Ex. 1 |
|---|---|---|---|---|---|---|
| <Polyisocyanate D> | | | | | | |
| 4,4'-diphenylmethane diisocyanate ("SUMIDUR 44S") | 21.6 | — | 21.6 | 21.6 | | 21.6 |
| <Terminal Isocyanate Prepolymer E> | | | | | | |
| Difunctional Polytetramethylene Glycol (Average Molecular Weight: 650 "PTMG650") | 28.2 | — | 28.2 | 28.2 | — | 28.2 |
| Difunctional Polytetramethylene Glycol (Average Molecular Weight: 250 "PolyTHF250") | — | 23.1 | — | — | — | — |
| 4,4'-diphenylmethane diisocyanate | 21.7 | 46.3 | 21.7 | 21.7 | — | 21.7 |
| Both End Isocyanate Prepolymer ("ADIPRENE LFH 120") | — | — | — | — | 86.7 | — |
| (B + D + E) | 100 | 100 | 100 | 100 | 100 | 100 |
| <Reaction Accelerator> | | | | | | |
| 2-methyltriethylenediamine ("Me-DABCO") | 0.1 | 0.1 | 0.1 | 0.1 | — | 0.1 |
| ADEKASTAB BT 11 | — | — | — | — | 0.015 | — |
| Volume Fraction of Water-Soluble Particles (%) | 10 | 10 | 35 | 3 | 2 | 0 |
| Tensile Product (kgf/cm) | 2817 | 10320 | 1120 | 3530 | 9980 | 3860 |
| Shore D Hardness | 75 | 83 | 81 | 71 | 65 | 69 |
| Polishing Rate (nm/min) | 200 | 180 | 300 | 160 | 200 | 40 |
| Presence of Scratches | None | None | None | None | None | Many |
| Flatness (nm) | 50 | 30 | 80 | 40 | 30 | 130 |

Ex.: Example, C. Ex.: Comparative Example

Example 1

28.2 parts by weight of polytetramethylene glycol (product of Mitsubishi Chemical Corporation, trade name "PTMG650") with a number average molecular weight of 650 which had two hydroxyl groups at both ends of a molecule and 21.7 parts by weight of 4,4'-diphenylmethane diisocyanate (product of Sumika Bayer Urethane Co., Ltd., trade name "SUMIDUR 44S") were charged into a reactor, maintained at 90° C. for 3 hours under agitation so as to react and then cooled so as to obtain a both end isocyanate prepolymer.

As a crosslinking agent, 21.6 parts by weight of addition reaction product of glycerin and a propylene oxide (product of NOF CORPORATION, trade name "UNIOL TG330") with a number average molecular weight of 330 which had three hydroxyl groups and 6.9 parts by weight of polytetramethylene glycol "PTMG650" were used. In the crosslinking agent, 14.5 parts by weight of β-cyclodextrin (product of BIO RESEARCH CORPORATION OF YOKOHAMA, trade name "DEXPAL β-100", average particle diameter: 20 μm) which was water-soluble particles was dispersed by agitation, and as a reaction accelerator, 0.1 parts by weight of 2-methyltriethylenediamine (product of Air Products Japan, Inc., trade name "Me-DABCO") was dissolved by agitation. This mixture was added to the reactor containing the above both end isocyanate prepolymer.

Further, 21.6 parts by weight of 4,4'-diphenylmethane diisocyanate "SUMIDUR 44S" was added to the above reactor containing the both end isocyanate prepolymer, and the resulting mixture was agitated at room temperature at 200 rpm for 2 minutes and then defoamed under a reduced pressure so as to obtain a raw material mixture.

This raw material mixture was poured into a mold having a diameter of 60 cm and a thickness of 3 mm, kept at 80° C. for 20 minutes so as to react into a polyurethane and post-cured at 110° C. for 5 hours so as to give a polishing pad having a diameter of 60 cm and a thickness of 3 mm. The volume fraction of the water-soluble particles with respect to the whole polishing pad, i.e., the volume fraction of the water-soluble particles with respect to the total of the volumes of the polyurethane matrix and the water-soluble particles, was about 10%.

The obtained polishing pad showed a tensile product of 2,817 kgf/cm when a dumbbell-shaped type 3 test piece was subjected to a tensile test at a pulling rate of 500 mm/min and a testing temperature of 30° C. in accordance with JIS K 6251 "Method of Conducting Tensile Test for Vulcanized Rubber" and ruptured. Further, the Shore D hardness of the pad was 75.

Further, the polishing performance of the polishing pad was evaluated as follows.

(1) Polishing Rate and Presence or Absence of Scratches

An $SiO_2$ solid film semiconductor wafer (product of ADVANTEC CO., LTD., film thickness: 1,000 nm, thermal oxide wafer) was polished for 2 minutes by use of the following conditions, and a polishing rate and the presence or absence of scratches were evaluated. The film thickness was measured before and after polishing by use of an optical film thickness meter, and the polishing rate was calculated from these film thicknesses. Meanwhile, the scratches were checked by observing the polished surface of the $SiO_2$ film wafer after polishing under an electron microscope. Further, to roughen the surface of the pad before evaluation of the polishing performance, the surface was treated for 20 minutes under the same conditions as those for polishing except that a #100 diamond dresser was used and 1,500 ml/min of running water was used in place of slurry.

Slurry: 3-time diluted CMS1101 (product of JSR Corporation) Chemical Mechanical Polishing Device: EPO112 (product of Ebara Corporation)

Slurry Feed Rate: 200 ml/min

Polishing Load: 400 g/cm$^2$

Revolution Speed of Surface Table: 30 rpm

Revolution Speed of Head: 31 rpm

As a result, the polishing rate was 200 nm/min, and few scratches were found.

(2) Evaluation of Flatness

The polished amount of an $SiO_2$ film in the concave portion of the pattern when the initial level difference, which was about 800 nm, of the convex portion of the pattern of a surface $SiO_2$ film patterned semiconductor wafer (product of SKW Associates, Inc., trade name "SKW-7") having a pattern initial level difference of about 800 nm was polished by use of the above conditions was taken as flatness. The smaller this number is, the better the ability of flattening the pattern wafer is. The film thickness of the $SiO_2$ film was measured before and after polishing by an optical film thickness meter and calculated. As a result, flatness was 50 nm which was considered good.

Example 2

23.1 parts by weight of polytetramethylene glycol (product of BASF Japan Ltd., trade name "PolyTHF250") with a weight average molecular weight of 250 which had two hydroxyl groups at both ends of a molecule and 46.3 parts by weight of 4,4'-diphenylmethane diisocyanate "SUMIDULE 44S" were charged into a reactor, kept at 90° C. for 3 hours under agitation so as to react and then cooled so as to obtain a both end isocyanate prepolymer.

As a crosslinking agent, 13.2 parts by weight of "UNIOL TG330" with a number average molecular weight of 330 which had three hydroxyl groups and 17.4 parts by weight of polytetramethylene glycol "PTMG650" were used. In the crosslinking agent, 14.5 parts by weight of β-cyclodextrin "DEXPAL β-100" which was water-soluble particles was dispersed by agitation, and as a curing catalyst, 0.1 parts by weight of 2-methyltriethylenediamine "Me-DABCO" was dissolved by agitation. This mixture was added to the reactor containing the above both end isocyanate prepolymer. The resulting mixture was agitated at room temperature at 200 rpm for 2 minutes and then defoamed under a reduced pressure so as to obtain a raw material mixture.

This raw material mixture was poured into a mold having a diameter of 60 cm and a thickness of 3 mm, kept at 80° C. for 20 minutes so as to react into a polyurethane and post-cured at 110° C. for 5 hours so as to give a polishing pad having a diameter of 60 cm and a thickness of 3 mm. The volume fraction of the water-soluble particles with respect to the whole polishing pad, i.e., the volume fraction of the water-soluble particles with respect to the total of the volumes of the polyurethane matrix and the water-soluble particles, was about 10%.

The obtained polishing pad showed a tensile product of 10,320 kgf/cm after subjected to a tensile test and a Shore D hardness of 83.

Further, a polishing rate, the presence or absence of scratches and flatness were evaluated in the same manner as in Example 1. As a result, the polishing rate was 180 nm/min, few scratches were found, and the flatness was 30 nm, indicating that the flatness of a polished surface was very good.

Example 3

A raw material mixture for a polyurethane was obtained in the same manner as in Example 1 except that the amount of β-cyclodextrin "DEXPAL β-100" which was water-soluble particles was changed to 70 parts by weight. Further, a reaction to obtain a polyurethane and post-curing were carried out in the same manner as in Example 1 so as to obtain a polishing pad having a diameter of 60 cm and a thickness of 3 mm. The volume fraction of the water-soluble particles with respect to the whole polishing pad, i.e., the volume fraction of the water-soluble particles with respect to the total of the volumes of the polyurethane matrix and the water-soluble particles, was about 35%.

The obtained polishing pad showed a tensile product of 1,120 kgf/cm after subjected to a tensile test and a Shore D hardness of 81.

Further, a polishing rate, the presence or absence of scratches and flatness were evaluated in the same manner as in Example 1. As a result, the polishing rate was 300 nm/min, few scratches were found, and the flatness was 80 nm which was good.

Example 4

A raw material mixture for a polyurethane was obtained in the same manner as in Example 1 except that the amount of β-cyclodextrin "DEXPAL β-100" which was water-soluble particles was changed to 4 parts by weight. Further, a reaction to obtain a polyurethane and post-curing were carried out in the same manner as in Example 1 so as to obtain a polishing pad having a diameter of 60 cm and a thickness of 3 mm. The volume fraction of the water-soluble particles with respect to the whole polishing pad, i.e., the volume fraction of the water-soluble particles with respect to the total of the volumes of the polyurethane matrix and the water-soluble particles, was about 3%.

The obtained polishing pad showed a tensile product of 3,530 kgf/cm after subjected to a tensile test and a Shore D hardness of 71.

Further, a polishing rate, the presence or absence of scratches and flatness were evaluated in the same manner as in Example 1. As a result, the polishing rate was 160 nm/min, few scratches were found, and the flatness was 40 nm which was good.

Example 5

As a crosslinking agent, 2.2 parts by weight of trimethylolpropane having three hydroxyl groups (product of BASF Japan Ltd., trade name "TMP") and 11.1 parts by weight of 1,6-hexanediol having two hydroxyl groups (product of Wako Pure Chemical Industries, Ltd.) were used. In the crosslinking agent, 2.5 parts by weight of β-cyclodextrin (product of BIO RESEARCH CORPORATION OF YOKOHAMA, trade name "DEXPAL β-100", average particle diameter: 20 μm) which was water-soluble particles was dispersed by agitation, and as a reaction accelerator, 0.015 parts by weight of dibutyltin dimaleate (product of Asahi Denka Co., Ltd., trade name "ADEKASTAB BT 11") was dissolved by agitation. To this mixture, 86.7 parts by weight of ADIPRENE LFH 120 (product of Uniroyal Chemical Company, Inc.) which was commercially available both end isocyanate prepolymer having a structure that 1,6-hexamethylene diisocyanate was reacted with both ends of a polytetramethylene glycol was added. Thereafter, the resulting mixture was agitated at room temperature at 200 rpm for 2 minutes and then defoamed under a reduced pressure so as to obtain a raw material mixture. Further, polymerization of polyurethane and post-curing were carried out in the same manner as in Example 1 so as to obtain a polishing pad having a diameter of 60 cm and a thickness of 3 mm.

The volume fraction of the water-soluble particles with respect to the whole polishing pad, i.e., the volume fraction of the water-soluble particles with respect to the total of the volumes of the polyurethane matrix and the water-soluble particles, was about 2%.

The obtained polishing pad showed a tensile product of 9,980 kgf/cm after subjected to a tensile test and a Shore D hardness of 65.

Further, a polishing rate, the presence or absence of scratches and flatness were evaluated in the same manner as in Example 1. As a result, the polishing rate was 200 nm/min, few scratches were found, and the flatness was 30 nm which was good.

Comparative Example 1

A raw material mixture for a polyurethane was obtained in the same manner as in Example 1 except that β-cyclodextrin which was water-soluble particles was not used. Further, a reaction to obtain a polyurethane and post-curing were carried out in the same manner as in Example 1 so as to obtain a polishing pad having a diameter of 60 cm and a thickness of 3 mm and free of the water-soluble particle.

The obtained polishing pad showed a tensile product of 3,860 kgf/cm after subjected to a tensile test and a Shore D hardness of 69.

Further, the tensile product, the Shore D hardness, a polishing rate, the presence or absence of scratches and flatness were evaluated in the same manner as in Example 1. As a result, the polishing rate was 40 nm/min which was poor, and a number of scratches were observed. The flatness was 130 nm which was poor.

Comparative Example 1 (polishing pad containing no water-soluble particles) showed a low polishing rate of 40 nm/min. Further, it had many scratches and also showed a poor flatness of 130 nm. Meanwhile, in the case of the polishing pads of the present invention of Examples 1 to 4, good results were obtained for all physical properties, and well-balanced, excellent polishing pads were obtained. Therefore, these polishing pads can be suitably used for polishing the surface of a semiconductor wafer, et al.

As described in detail above, according to the method of the present invention for producing a polishing pad, a polishing pad which has water-soluble particles dispersed uniformly therein in a matrix, a toughness and an excellent polishing performance can be obtained.

What is claimed is:

1. A method for manufacturing a polishing pad, comprising the steps of:

dispersing water-soluble particles which are a polysaccharide in a crosslinking agent to form a dispersion;

mixing the dispersion with a polyisocyanate and/or an isocyanate terminated urethane prepolymer to produce a mixed solution; and reacting the mixed solution to produce a polishing pad which is composed of a polishing layer containing the water-soluble particles dispersed in the polymer matrix and having a non-porous structure.

2. The method of manufacturing a polishing pad according to claim 1, wherein reduced-pressure defoaming is carried out after the dispersion and the polyisocyanate and/or the isocyanate terminated urethane prepolymer are mixed together to form a mixed solution.

3. The method of claim 1, wherein the crosslinking agent has at least two functional groups having active hydrogen capable of reacting with an isocyanate group in the molecule.

4. The method of claim 2, wherein the crosslinking agent has at least two functional groups having active hydrogen capable of reacting with an isocyanate group in the molecule.

5. The method according to claim 3, wherein the crosslinking agent is a polyol and/or a polyamine.

6. The method according to claim 4, wherein the crosslinking agent is a polyol, an isocyanate terminated urethane prepolymer or a combination of a polyisocyanate and an isocyanate terminated urethane prepolymer is used in the step of forming the mixed solution, the isocyanate terminated polyurethane prepolymer is obtained by reacting a compound having at least two hydroxyl groups in the molecule with a polyisocyanate in an equivalent ratio of the hydroxyl group to the isocyanate group (OH group/NCO group) of 1/1.8 to 1/2.4, and the equivalent ratio of the hydroxyl group contained in the crosslinking agent to the isocyanate group contained in the isocyanate raw material (OH group/NCO group) is 1/0.9 to 1/1.4.

7. The method according to claim 5, wherein the polyol is a diol and/or a triol.

8. The method according to claim 1, wherein a crosslinking agent having a number average molecular weight of 5,000 or less is contained in an amount of 30 wt % or more based on 100 mass % of the total of all crosslinking agents.

9. The method according to claim 2, wherein a crosslinking agent having a number average molecular weight of 5,000 or less is contained in an amount of 30 wt % or more based on 100 mass % of the total of all crosslinking agents.

10. The method according to claim 1, wherein the polysaccharide is starch.

11. The method according to claim 1, wherein the polysaccharide is dextrin, cyclodextrin, lactose, mannitol or a cellulose.

12. The method according to claim 1, wherein the polysaccharide is hydroxypropylcellulose or methylcellulose.

* * * * *